US005704878A

United States Patent [19]

Chen

[11] Patent Number: 5,704,878

[45] Date of Patent: Jan. 6, 1998

[54] STEPPING EXCERCISER

[76] Inventor: Ping Chen, No. 29, Nanmei St., Nantun Li, Natun Dist., Taichung, Taiwan

[21] Appl. No.: 786,083

[22] Filed: Jan. 17, 1997

[51] Int. Cl.[6] ..... A63B 21/00

[52] U.S. Cl. ..... 482/52; 482/57

[58] Field of Search ..... 482/57, 52, 53, 482/80, 79

[56] References Cited

U.S. PATENT DOCUMENTS

| | | | |
|---|---|---|---|
| 2,641,249 | 6/1953 | Brookman | 482/57 |
| 4,915,374 | 4/1990 | Watkins | 482/57 |
| 5,163,886 | 11/1992 | Seol | 482/52 |

*Primary Examiner*—Stephen R. Crow
*Attorney, Agent, or Firm*—Martin Korn

[57] ABSTRACT

A stepping exerciser includes a base frame having a first end portion, a second end portion, a first side wall, and a second side wall. A supporting handle has a lower end portion mounted on the first end portion of the base frame in an inclined manner, and an upper end portion with a handgrip mounted thereon. A driving axle is rotatably mounted on the second end portion of the base frame and has a first end and a second end extending through the first and the second side wall of the base frame respectively. A first stepping member has a mediate portion fixedly mounted on the first end of the driving axle. A second stepping member is disposed in an inclined manner with the first stepping member and has a mediate portion fixedly mounted on the second end of the driving axle. A tension adjusting mechanism is mounted in the base frame and is engaged with the driving axle for damping a rotation of the driving axle.

2 Claims, 13 Drawing Sheets

STEPPING EXCERCISER

FIELD OF THE INVENTION

The present invention relates to a stepping exerciser.

BACKGROUND OF THE INVENTION

Sometimes, our activities are restricted to being indoors due to the heavy traffic or a bad weather, therefore, it is necessary to provide an exerciser which can be employed in the house for exercising purposes.

The present invention has arisen to solve the above-mentioned problem.

SUMMARY OF THE INVENTION

In accordance with one aspect of the present invention, there is provided a stepping exerciser comprising a base frame having a first end portion, a second end portion, a first side wall, and a second side wall.

A supporting handle has a lower end portion mounted on the first end portion of the base frame in an inclined manner, and an upper end portion with a handgrip mounted thereon.

A driving axle is rotatably mounted on the second end portion of the base frame and has a first end and a second end extending through the first and the second side wall of the base frame respectively.

A first stepping member has a mediate portion fixedly mounted on the first end of the driving axle. A second stepping member is disposed in an inclined manner with the first stepping member and has a mediate portion fixedly mounted on the second end of the driving axle.

A tension adjusting mechanism is mounted in the base frame and is engaged with the driving axle for damping a rotation of the driving axle.

Further features of the present invention will become apparent from a careful reading of the detailed description with appropriate reference to the accompanying drawings.

DETAILED DESCRIPTION OF THE PREFERRED EMBODIMENTS

Figure 1:
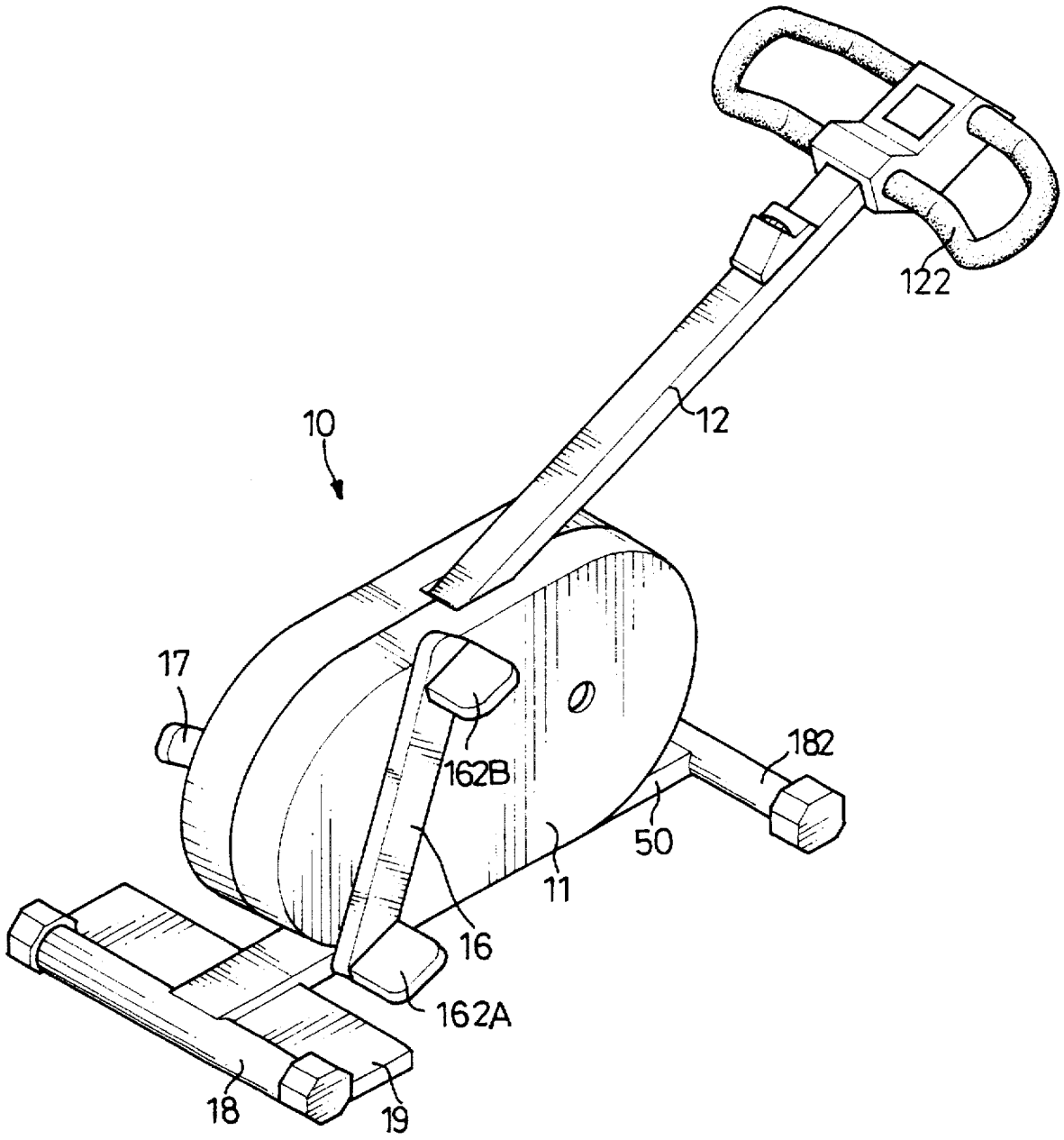
FIG. 1 is a perspective view of a stepping exerciser in accordance with the present invention.

Referring to the drawings, and initially to FIGS. 1–4, a stepping exerciser 10 in accordance with the present invention comprises a base frame 11 having a first end portion, a second end portion, a first side wall, and a second side wall.

A supporting handle 12 has a lower end portion mounted on the first end portion of the base frame 11 in an inclined manner, and an upper end portion with a handgrip 122 mounted thereon.

A driving axle 15 is rotatably mounted on the second end portion of the base frame 11 and has a first end and a second end extending through the first and the second side wall of the base frame 11 respectively.

A bushing 54 is mounted around the driving axle 15, and a single bearing 152 (see FIG. 2) or two bearings 152 (see FIG. 3) is/are rotatably mounted between the driving axle 15 and the bushing 54. An inverted T-shaped supporting member 50 has an upright beam 52 fixedly mounted on an underside of the bushing 54 for supporting the driving axle 15 and the bushing 54, and has two distal ends each with a beam 18 and a beam 182 mounted thereon respectively. A limiting plate 19 is mounted on the supporting member 50 and located adjacent to the beam 18.

A first stepping member has a mediate portion fixedly mounted on the first end of the driving axle 15, and a second stepping member is disposed in an inclined manner with the first stepping member and has a mediate portion fixedly mounted on the second end of the driving axle 15.

Preferably, the first stepping member includes a first elongate beam 16 with two distal ends each having a first pedal 162A (or 162B) mounted thereon, and the second stepping member includes a second elongate beam 17 with two distal ends each having a second pedal 172A (or 172B) mounted thereon. In addition, the first elongate beam 16 is disposed perpendicular to the second elongate beam 17.

A tension adjusting mechanism 30 is mounted in the base frame 11 and is engaged with the driving axle 15 for damping a rotation of the driving axle 15.

The tension adjusting mechanism 30 includes a driving sprocket 31 fixedly mounted on the second end of the driving axle 15 to rotate therewith, a driven axle 36 rotatably mounted in the first end portion of the base frame 11, a driven sprocket 33 fixedly mounted on one end of the driven axle 36, a chain 32 meshing with the driving sprocket 31 and the driven sprocket 33, a tension wheel 34 fixedly mounted on a mediate portion of the driven axle 36, and a tension belt 35 mounted on a periphery of the tension wheel 34.

The tension wheel 34 can drive the driven axle 36 to rotate along a direction opposite to that of the rotation of the driving axle 15 by means of the tension belt 35, thereby capable of providing a resistance for damping the rotation of the driving axle 15.

Figure 2:
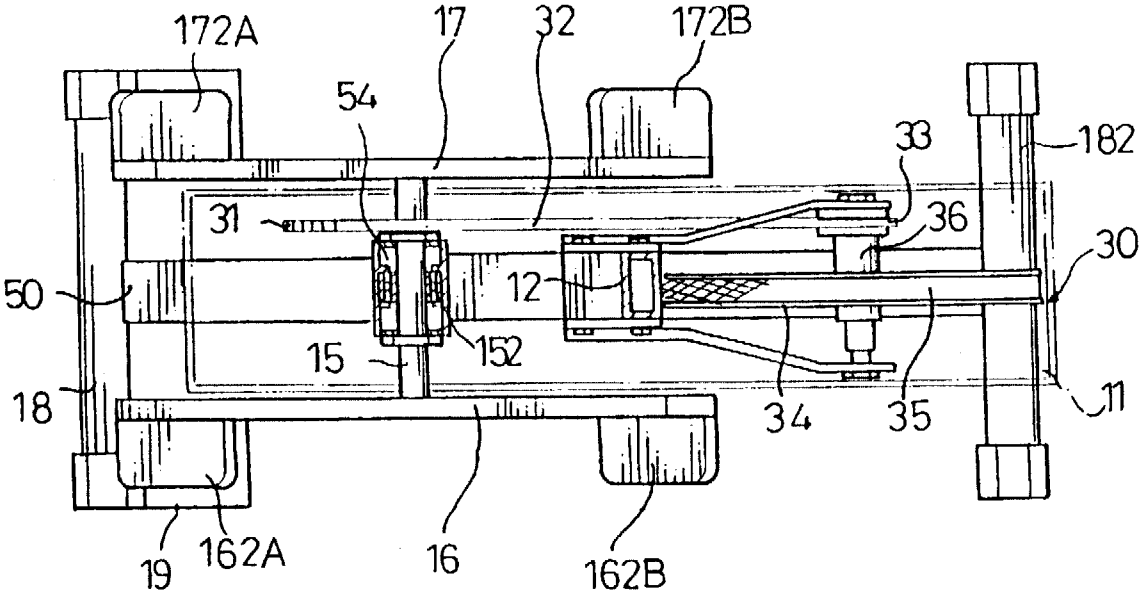
FIGS. 2 and 3 are top plan partially cross-sectional views of FIG. 1.
Figure 3:
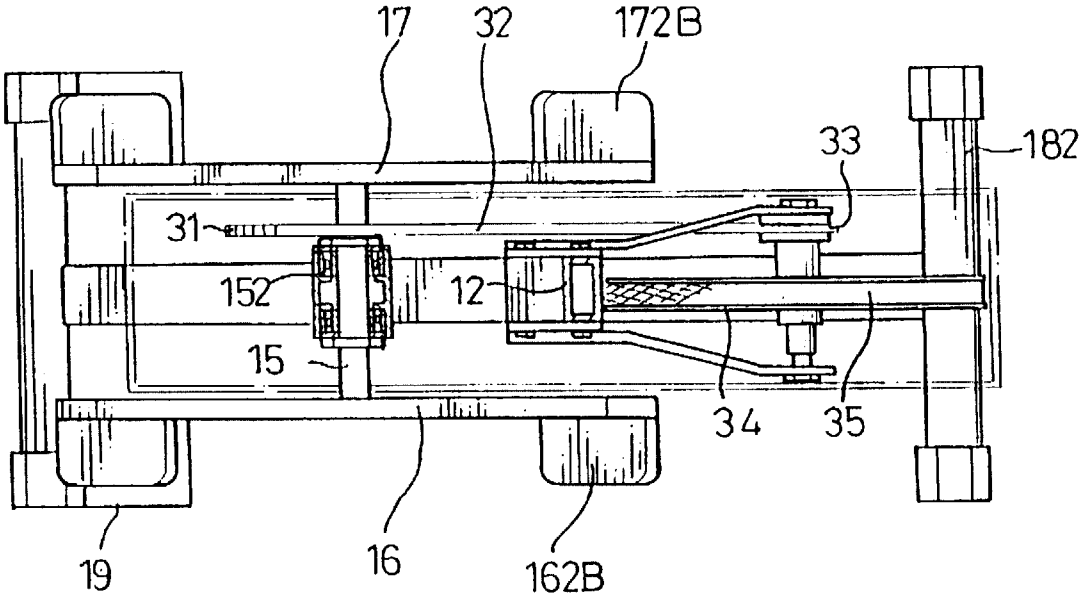
Figure 4:
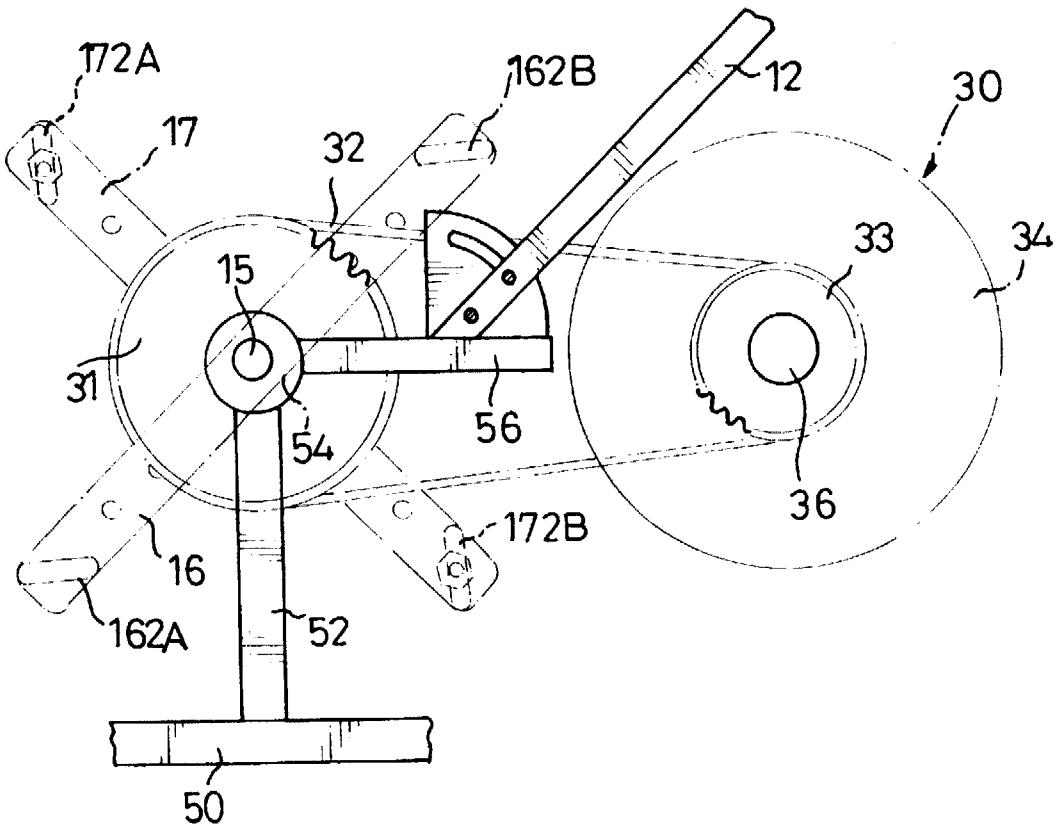
FIG. 4 is a front plan partially cut-away view of FIG. 1.
Figure 5:
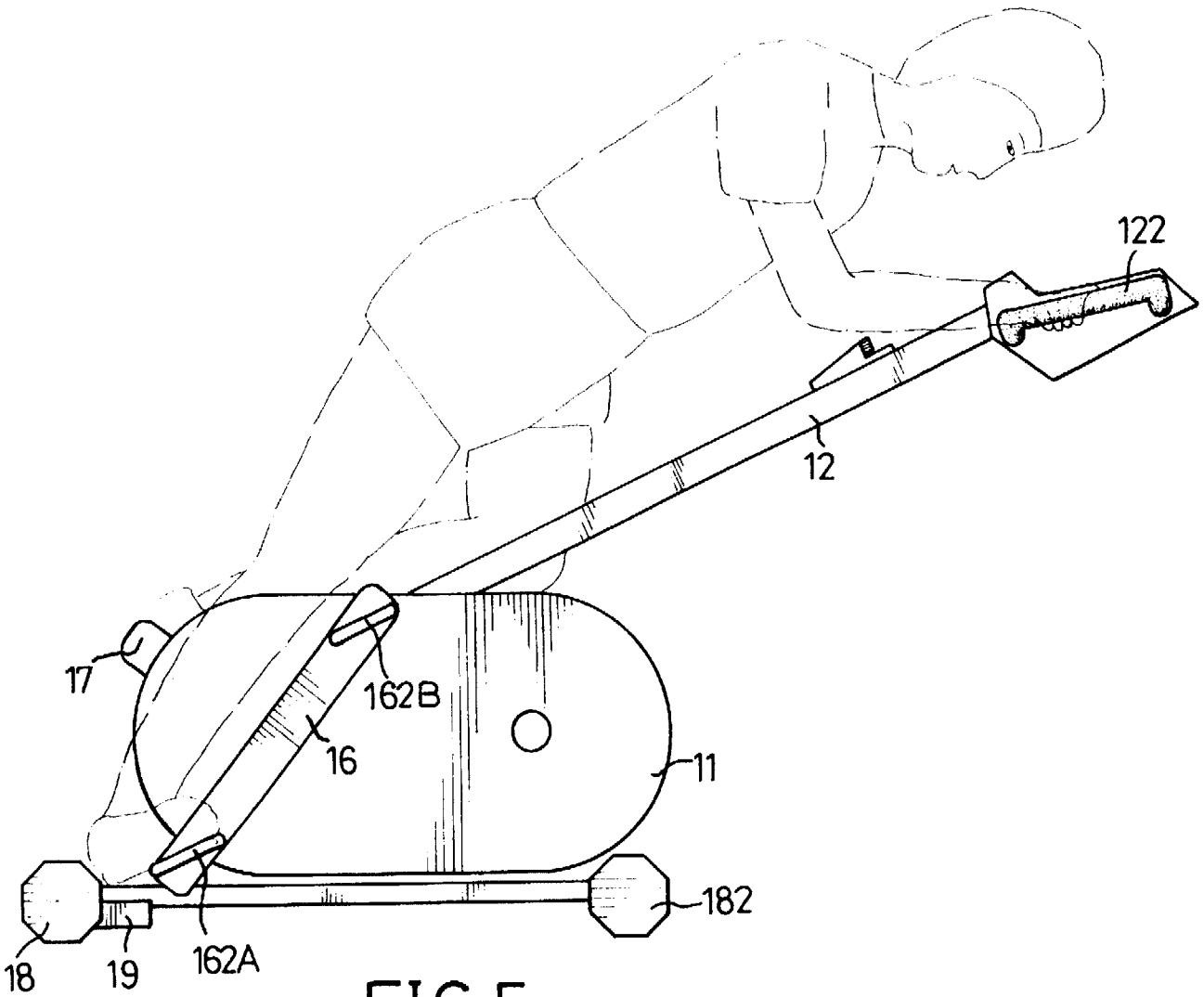
FIG. 5 is an operational view of FIG. 1.

In operation, referring to FIGS. 4 and 5 with reference to FIGS. 1 and 2, a user can use the stepping exerciser with his two hands holding the handgrip 122, and with his right foot stepping on the first pedal 162A to rotate the driving axle 15, thereby rotating the second elongate beam 17 which can in turn rotate the second pedal 172A.

When the first pedal 162A and the second pedal 172A are moved to the position as shown in FIGS. 4 and 5, the user's left foot can step on the second pedal 172A to rotate the driving axle 15, thereby rotating the first beam 16 which can in turn rotate the first pedal 162B. In such a situation, the user's right foot can be elevated higher than the first pedal 162B, thereby preventing the first pedal 162B from hitting his right foot.

When the second pedal 172A is moved to a lowermost position, the user's right foot can step on the first pedal 162B to rotate the driving axle 15, thereby rotating the second beam 17 which can in turn rotate the second pedal 172B. In such a situation, the user's left foot can be elevated higher than the second pedal 172B, thereby preventing the second pedal 17 from hitting his left foot.

When the first pedal 162B is moved to a lowermost position, the user's left foot can step on the second pedal 172B to rotate the driving axle 15, thereby rotating the first beam 16 which can in turn rotate the first pedal 162A. In such a situation, the user's right foot can be elevated higher than the first pedal 162A, thereby preventing the first pedal 162A from hitting his right foot.

When the second pedal 172B is moved to a lowermost position, the user's right foot can step on the first pedal 162A to rotate the driving axle 15, thereby rotating the second beam 17 which can in turn rotate the second pedal 172A to the original position as shown in FIGS. 4 and 5. In such a situation, the user's left foot can be elevated higher than the second pedal 172A, thereby preventing the second pedal 172A from hitting his left foot.

The above-mentioned operations can be repeated such that the user can step on the first beam 16 and the second beam 17 alternately, thereby obtaining a stepping sensation so as exercise his body.

Figure 6:
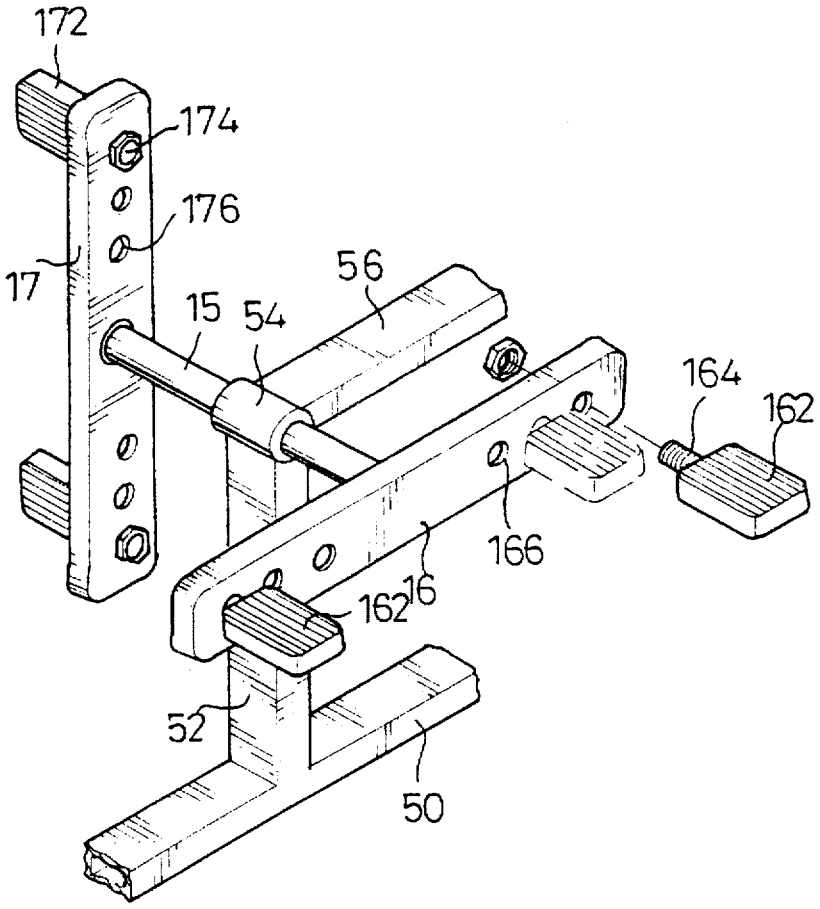
FIGS. 6–9 show different types of stepping members.

Referring to FIG. 6, each of the two distal ends of the first (or second) elongate beam 16 (or 17) has a plurality of adjusting holes 166 (or 176) defined therein, and the first (or second) pedal 162 (or 172) includes a stub 164 (or 174) pivotally mounted in one of the adjusting holes 166 (or 176).

Figure 7:
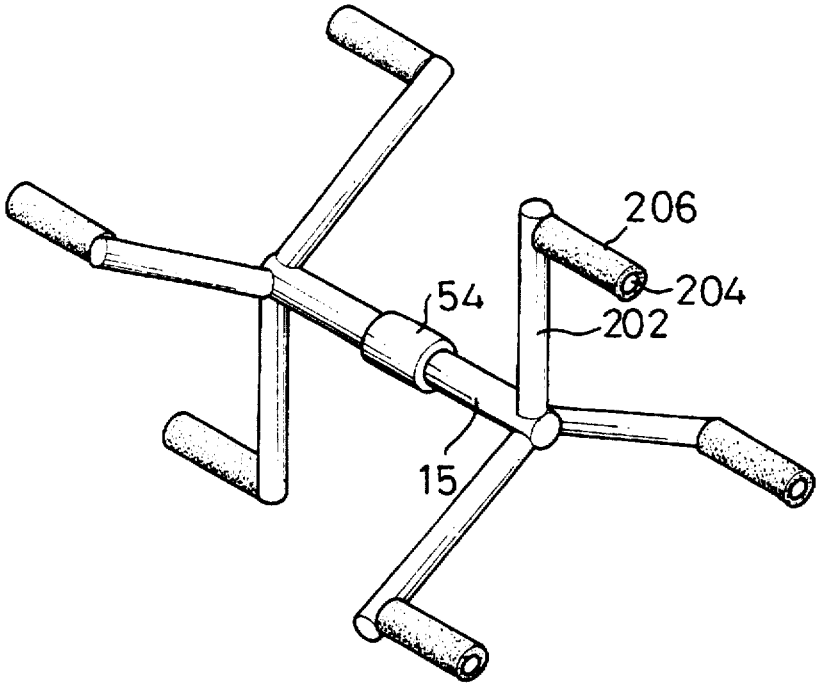

Referring to FIG. 7, each of the first and second stepping members includes a plurality of upright rods 202 each having a first end fixedly mounted on one end of the driving axle 15 and a second end with a crossbar 204 mounted thereon, and a cushion 206 mounted on the crossbar 204.

Figure 8:
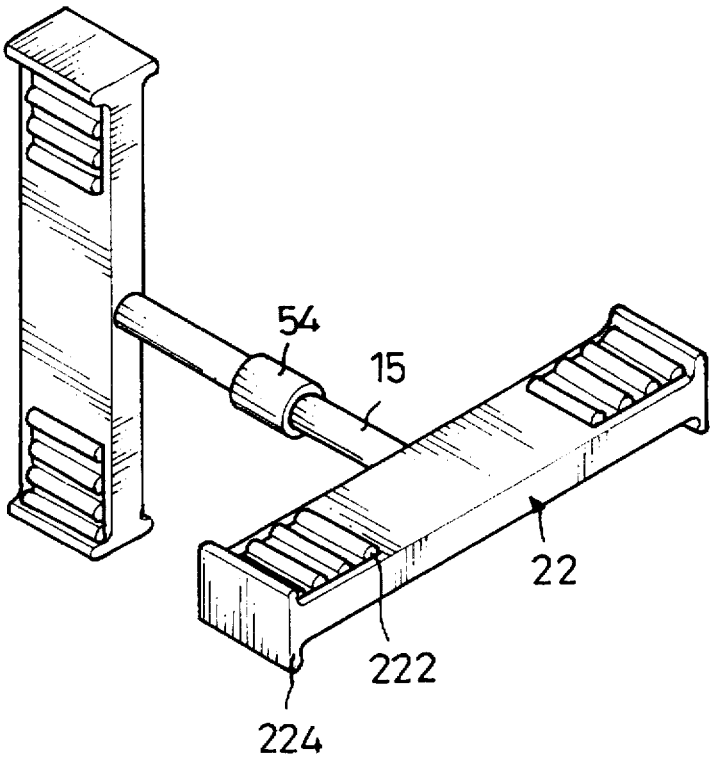

Referring to FIG. 8, each of the first and second stepping members includes an elongate beam 22 with two distal ends each having a plurality of ribs 222 mounted thereon and each having an abutting edge 224 protruding outwardly therefrom.

Figure 9:
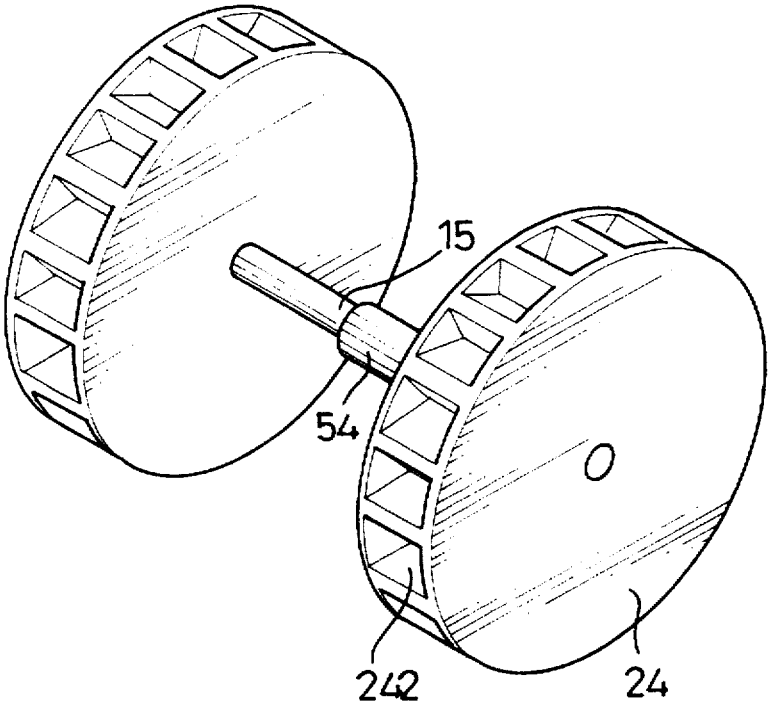

Referring to FIG. 9, each of the first and second stepping members includes a stepping wheel 24 having a plurality of recesses 242 each defined along a periphery thereof.

Figure 12:
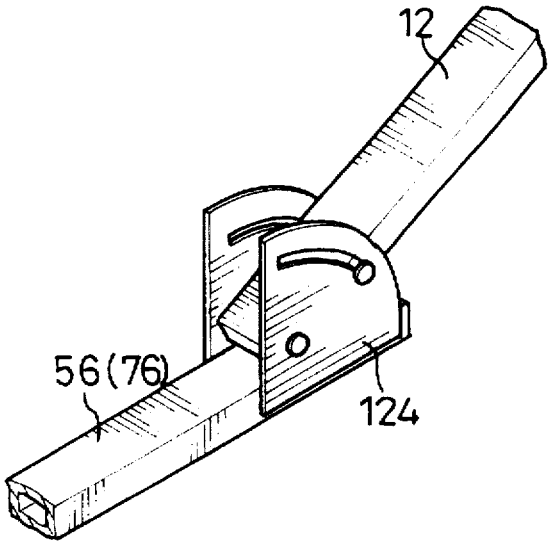
FIG. 12 shows a supporting handle adjustably mounted on a connecting beam.

Referring to FIGS. 4 and 12, a connecting beam 56 has a first end fixedly attached to the bushing 54 and a second end with two adjusting sectors 124 fixedly mounted thereon and between which the lower end of the supporting handle 12 is adjustably mounted.

Figure 10:
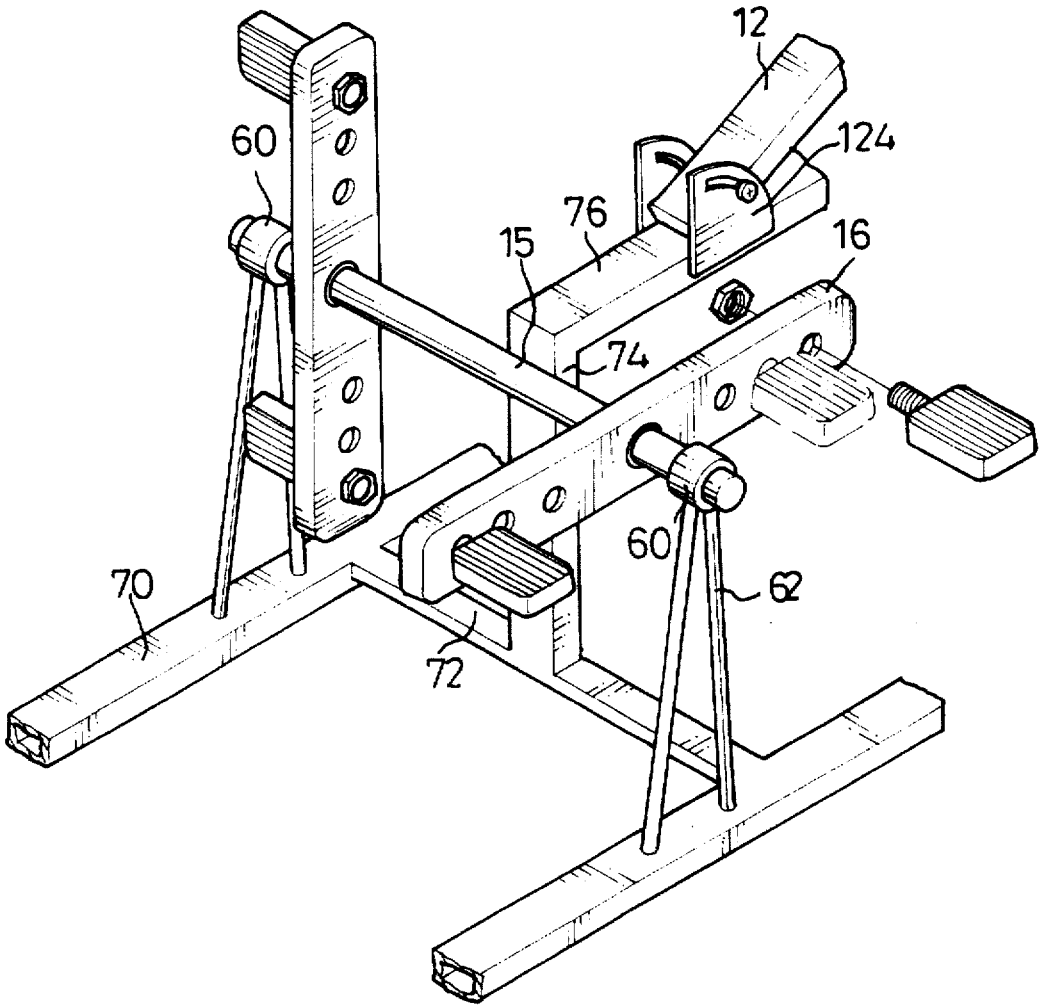
FIG. 10 shows another embodiment in accordance with the present invention.
Figure 11:
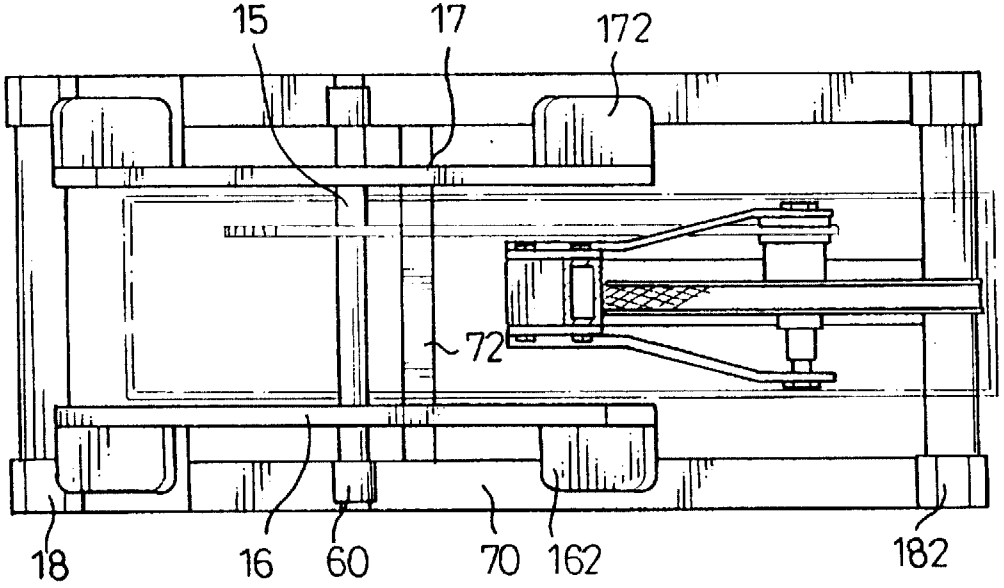
FIG. 11 is a top plan partially cross-sectional view of FIG. 10.

Referring to FIGS. 10–12, in accordance with another embodiment of the present invention, two bushings 60 are each mounted around a respective one end of the driving axle 15. Two supporting brackets 62 are each mounted on a supporting beam 70 for supporting a respective bushing 60 and the driving axle 15. An inverted T-shaped member has a horizontal section 72 mounted between the two supporting beams 70 and a vertical section 74 to which one end of a connecting beam 76 is fixedly attached.

Figure 14:
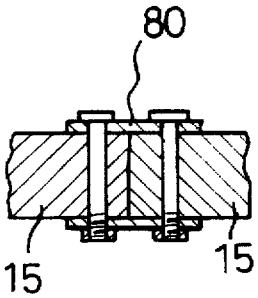
FIG. 14 is a top plan partially cross-sectional view of FIG. 13.
Figure 13:
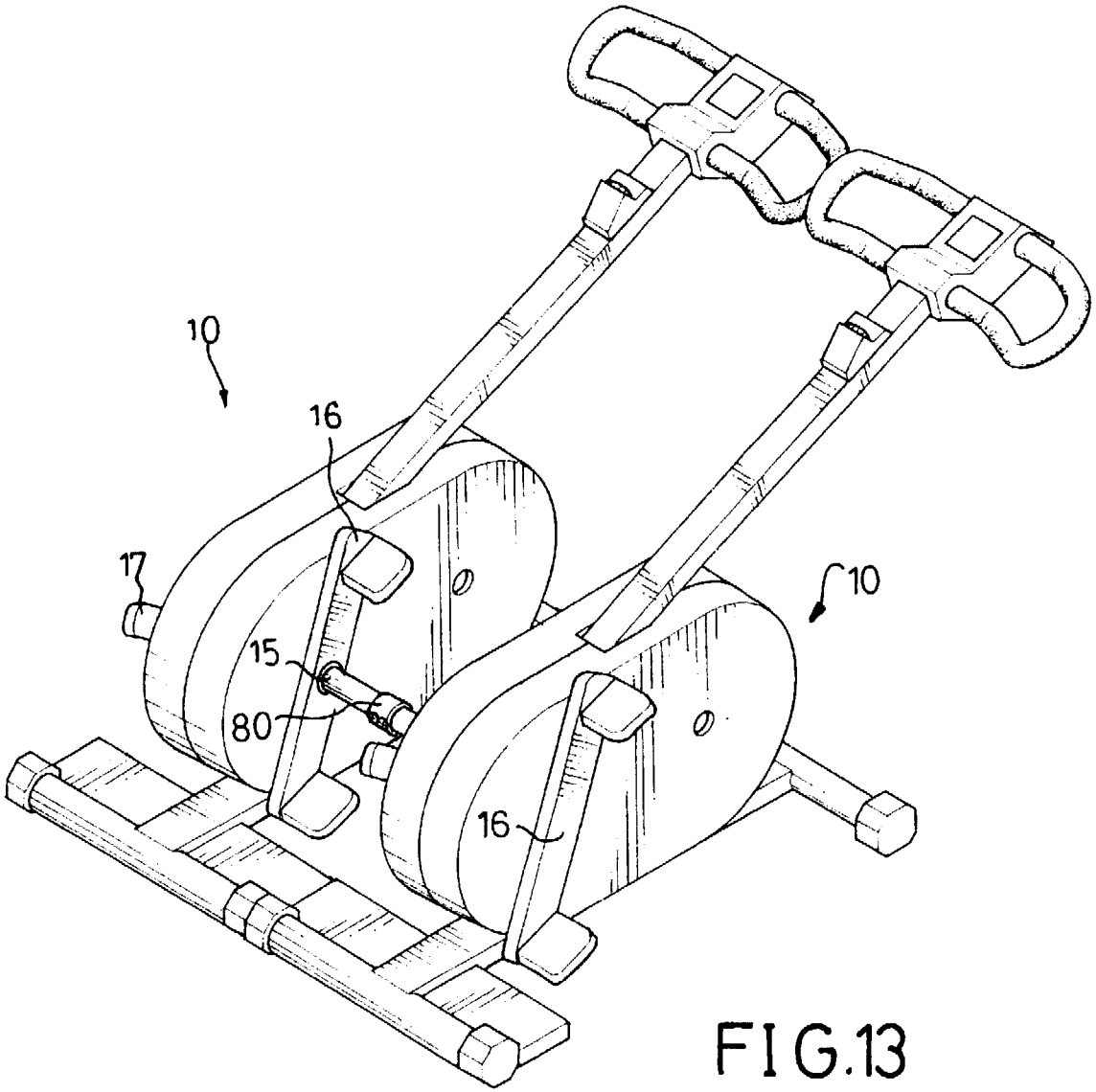
FIG. 13 shows two stepping exercisers being combined together.

Referring to FIGS. 13 and 14, two stepping exercisers 10 can be combined together by means of connecting two driving axles 15 with a coupling 80.

It should be clear to those skilled in the art that further embodiments may be made without departing from the scope and spirit of the present invention.

What is claimed is:

1. A stepping exerciser comprising:

a base frame (11) having a first end portion, a second end portion, a first side wall, and a second side wall;

a supporting handle (12) having a lower end portion mounted on the first end portion of said base frame (11) in an inclined manner, and an upper end portion with a handgrip (122) mounted thereon;

a driving axle (15) rotatably mounted on said second end portion of said base frame (11) and having a first end and a second end extending through said first and said second side wall of said base frame (11) respectively;

a first stepping member including a first elongate beam (16) having a mediate portion fixedly mounted on said first end of said driving axle (15), said first elongate beam (16) having two distal ends, each end thereof including a plurality of adjusting holes (166);

two first pedals (162) each including a stub (164) pivotally mounted in a corresponding one of said adjusting holes (166) of each of said two distal ends of said first elongate beam (16);

a second stepping member disposed in an inclined manner with said first stepping member and including a second elongate beam (17) having a mediate portion fixedly mounted on said second end of said driving axis (15), said second elongate beam (17) having two distal ends, each end thereof including a second pedal (172) mounted thereon;

a tension adjusting mechanism (30) mounted in said base frame (11) and engaged with said driving axle (15) for damping a rotation of said driving axle (15); and resistance means (34) for creating a damping action complementing said tension adjusting mechanism (30).

2. The stepping exerciser in accordance with claim 1, wherein each of the two distal ends of said second elongate beam (17) includes a plurality of adjusting holes (176), and said second pedal (172) includes a stub (174) pivotally mounted in a corresponding one of said adjusting holes (176).

* * * * *